US010518385B2

(12) United States Patent
Carpenter

(10) Patent No.: US 10,518,385 B2
(45) Date of Patent: Dec. 31, 2019

(54) APPARATUS AND PROCESS FOR SURFACE TREATING INTERIOR OF A WORKPIECE

(71) Applicant: Steven James Carpenter, East Jordan, MI (US)

(72) Inventor: Steven James Carpenter, East Jordan, MI (US)

( * ) Notice: Subject to any disclaimer, the term of this patent is extended or adjusted under 35 U.S.C. 154(b) by 210 days.

(21) Appl. No.: 15/340,484

(22) Filed: Nov. 1, 2016

(65) Prior Publication Data

US 2018/0117735 A1 May 3, 2018

(51) Int. Cl.

| | |
|---|---|
| ***B08B 9/057*** | (2006.01) |
| ***B24C 3/32*** | (2006.01) |
| ***B24C 1/08*** | (2006.01) |
| ***B24C 3/04*** | (2006.01) |
| ***B08B 3/02*** | (2006.01) |
| ***B08B 5/02*** | (2006.01) |
| ***B08B 9/00*** | (2006.01) |

(52) U.S. Cl.

CPC ..... *B24C 3/325* (2013.01); *B08B 3/024* (2013.01); *B08B 5/02* (2013.01); *B08B 9/00* (2013.01); *B08B 9/057* (2013.01); *B24C 1/083* (2013.01); *B24C 3/04* (2013.01)

(58) Field of Classification Search

None

See application file for complete search history.

(56) References Cited

U.S. PATENT DOCUMENTS

| | | | | |
|---|---|---|---|---|
| 4,380,477 | A * | 4/1983 | Saunders | B24C 5/02 134/7 |
| 5,653,819 | A * | 8/1997 | Bee | B08B 9/021 134/10 |
| 5,992,404 | A * | 11/1999 | Bleyer | B24C 3/02 125/26 |
| 6,808,439 | B2 | 10/2004 | Carpenter | |
| 7,063,593 | B2 | 6/2006 | Carpenter | |
| 2010/0186784 | A1* | 7/2010 | Ross | B05B 3/028 134/167 R |
| 2011/0061692 | A1* | 3/2011 | Gopalan | B05B 1/08 134/169 R |

* cited by examiner

*Primary Examiner* — Katelyn B Whatley
(74) *Attorney, Agent, or Firm* — Flynn Thiel, P.C.

(57) ABSTRACT

An apparatus for treating an interior surface of a workpiece comprising at least three nozzles ejecting treating material, with a first one and a second one ejecting the treating material substantially along first and second collinear lines. A third one of the nozzles ejects the treating material substantially along a third line substantially perpendicular to the first and second lines. The treating material ejected from the first one intersects with the treating material ejected from the second one at a first intersection area to radially deflect to form a first radial spray. The treating material ejected from the third one intersects with the first radial spray at a second intersection area to form a second radial spray of treating material. The interior surface of the workpiece adjacent the second intersection area is treated with the treating material of the second radial spray.

11 Claims, 3 Drawing Sheets

APPARATUS AND PROCESS FOR SURFACE TREATING INTERIOR OF A WORKPIECE

FIELD OF THE INVENTION

This invention relates to an apparatus and process for surface treating a boundary wall of an interior chamber associated with a workpiece such as a casting.

BACKGROUND OF THE INVENTION

Workpieces and particularly those formed as castings, forgings, fabrications and by machining often have interior chambers formed therein which have only limited accessibility. Such interior chambers are often shaped and sized so that portions thereof are of significantly larger cross section than any access opening which communicates therewith, and such interior chambers also often include passages or the like which communicate with or project transversely from a main chamber or passage, and as such direct communication with these transverse passages from the access opening is oftentimes difficult or impossible. It is usually necessary to attempt to effect at least some treatment of the walls which define the boundary of the interior chamber in an effort to improve the smoothness and finish thereof, and/or effect removal of debris which may be loosely or firmly attached thereto. This is particularly true when the workpiece is formed as a casting since the core used for defining the interior chamber during the casting process breaks down quickly after pouring and forming of the workpiece, and the material defining the core has to be removed through the access opening, but some material frequently becomes trapped in the interior chamber and/or adheres to the surrounding walls so as to create a poor quality surface.

The treating of the interior chambers of workpieces of this type has involved various techniques such as shaking the workpiece on a vibrator, or injecting streams of fluids such as air or water into the chamber in an attempt to dislodge debris from the chamber or from the walls thereof. This technique, however, is relatively ineffective with respect to creating any significant improvement with respect to the smoothness or quality of the boundary walls.

Because of the difficulties associated with treating (e.g., cleaning, deburring and shot peening) interior walls of chambers defined within workpieces such as castings, in many instances flexible brushes have been inserted, often manually, into the chamber to treat the boundary walls thereof. This technique is partially effective for those boundary walls which communicate with and are accessible from the access opening, but is of little value with respect to those walls which are associated with unusual shapes or transversly projecting regions of the interior chamber. Further, this technique is time consuming and inefficient.

Another technique is disclosed in U.S. Pat. No. 7,063,593 entitled APPARATUS AND PROCESS FOR SURFACE TREATING INTERIOR OF WORKPIECE. This patent discloses using a pair of oppositely facing sprays of cleaning fluid to impinge against each other to force the spray in a perpendicular direction. However, the system of this patent does not work with complex interior geometries.

SUMMARY OF THE INVENTION

An aspect of the present invention is to provide a method of treating an interior surface of a workpiece comprising providing at least three nozzles ejecting treating material, a first one and a second one of the at least three nozzles ejecting the treating material substantially along a first line and a second line, respectively, the first line and the second line being substantially collinear, a third one of the at least three nozzles ejecting the treating material substantially along a third line substantially perpendicular to the first line and the second line; intersecting the treating material ejected from the first one of the at least three nozzles with the treating material ejected from the second one of the at least three nozzles at a first intersection area; radially deflecting the treating material ejected from the first one of the at least three nozzles and the treating material ejected from the second one of the at least three nozzles at the first intersection area to form a first radial spray of treating material; intersecting the treating material ejected from the third one of the at least three nozzles with the first radial spray at a second intersection area; radially deflecting the treating material ejected from the third one of the at least three nozzles and the first radial spray at the second intersection area to form a second radial spray of treating material; and treating the interior surface of the workpiece adjacent the second intersection area with the treating material of the second radial spray.

Another aspect of the present invention is to provide an apparatus for treating an interior surface of a workpiece comprising at least three nozzles ejecting treating material, with a first one and a second one of the at least three nozzles ejecting the treating material substantially along a first line and a second line, respectively. The first line and the second line are substantially collinear. A third one of the at least three nozzles ejects the treating material substantially along a third line substantially perpendicular to the first line and the second line. The treating material ejected from the first one of the at least three nozzles intersects with the treating material ejected from the second one of the at least three nozzles at a first intersection area. The treating material ejected from the first one of the at least three nozzles and the treating material ejected from the second one of the at least three nozzles radially deflects at the first intersection area to form a first radial spray of treating material. The treating material ejected from the third one of the at least three nozzles intersects with the first radial spray at a second intersection area. The treating material ejected from the third one of the at least three nozzles and the first radial spray radially deflects at the second intersection area to form a second radial spray of treating material. The interior surface of the workpiece adjacent the second intersection area is treated with the treating material of the second radial spray.

Figure 1:
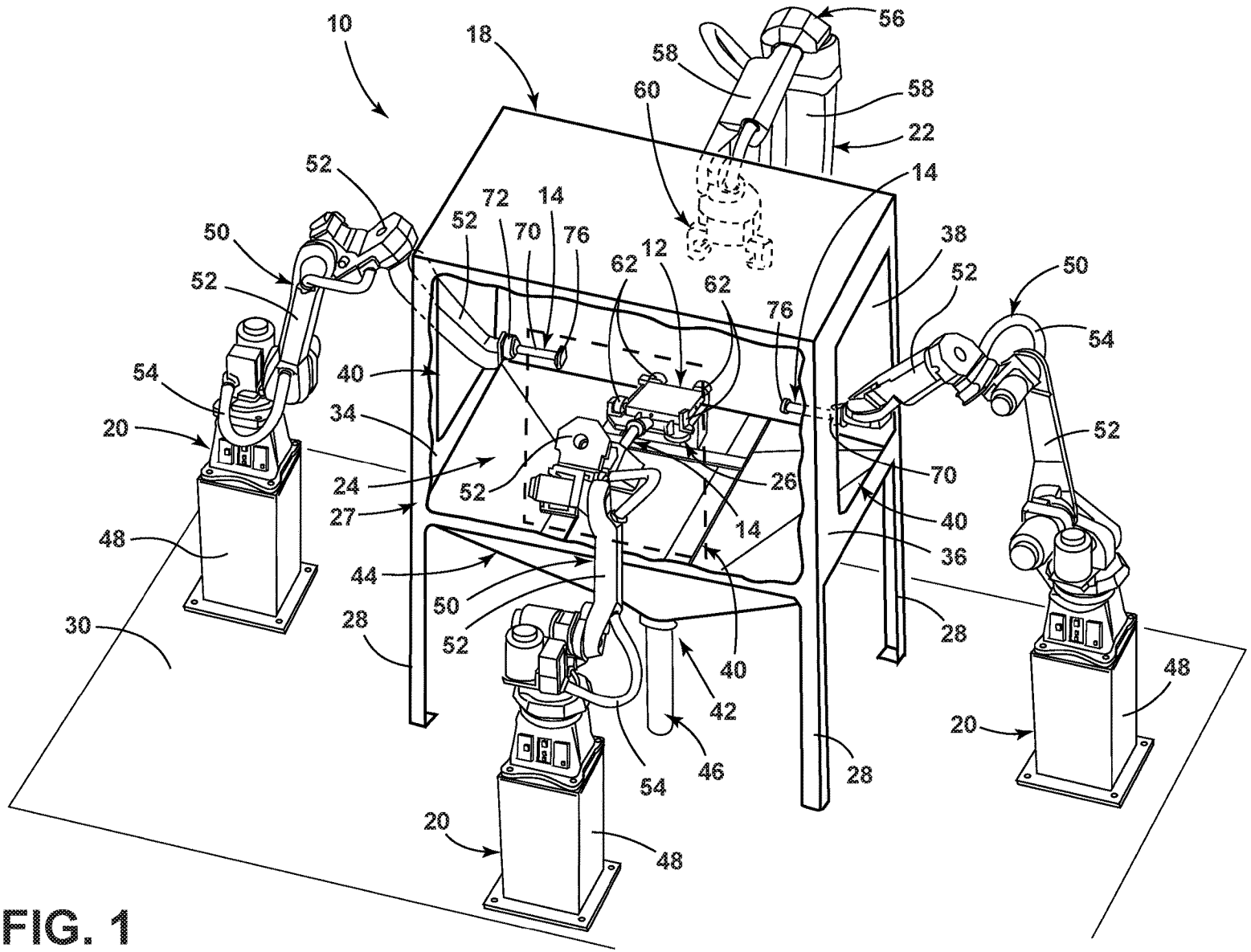
FIG. 1 is a perspective view of a workpiece finishing station according to the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from the geometric center of the apparatus and designated parts thereof, and will also refer to movement directions relative to the workpiece. Said terminology will include the words specifically mentioned, derivatives thereof, and words of similar import.

DETAILED DESCRIPTION

FIG. 1 illustrates one example of a workpiece treatment station 10 which can be utilized in conjunction with the surface treating apparatus and process disclosed herein. The workpiece treatment station 10 is configured to hold a workpiece 12 while nozzle members 14 are inserted therein to finish interior surfaces 16 (see FIG. 2) of the workpiece 12. While a particular workpiece treatment station 10 is illustrated in FIG. 1, any system that holds the workpiece 12 stationary while the nozzle members 14 are inserted therein can be used. The workpiece can be any workpiece to be treated (e.g., casting, forging, fabrication or one made by machining).

In the illustrated example, the workpiece treatment station 10 includes a main housing 18, a plurality of nozzle movable arm systems 20 having the nozzle members 14 thereon and surrounding the main housing 18, and a workpiece movable arm system 22 outside the main housing 18 for placing the workpiece 12 into and removing the workpiece 12 from the main housing 18. The main housing 18 defines therein an interior or shrouded treating chamber 24 and a rotatable workpiece-supporting turntable 26 is associated with the chamber 24 to permit the workpiece 12 to be mounted thereon. The rotatable workpiece-supporting turntable 26 is configured to hold and rotate the workpiece 12 within the main housing 18.

The illustrated workpiece 12 is treated within the main housing 18. The main housing 18 includes a chamber frame 27 having the interior or shrouded treating chamber 24 and a plurality of legs 28 supporting the chamber frame 27 on a surface 30. The chamber frame 27 is substantially hollow and includes a front face 32 (having a portion thereof cut away in FIG. 1), a first side face 34, a second side face 36 and a rear face 38. The front face 32, the first side face 34 and the second side face 36 include a sprayer opening 40 for allowing the nozzle members 14 and the nozzle movable arm systems 20 to move into, out of and about the interior of the interior or shrouded treating chamber 24 to interact with the workpiece 12 as outlined below. The sprayer opening 40 in the front face 32 of the chamber frame 27 is shown in dashed lines in FIG. 1 as most of the front face 32 of the chamber frame 27 is cut away in FIG. 1 to show the interior of the of the interior or shrouded treating chamber 24.

In the illustrated example, the chamber frame 27 of the main housing 18 includes a waste system 42 to collect and transport the treating material (e.g., abrasive particles) and/or debris which is utilized or created in the treating process. A funneled bottom surface 44 of the chamber frame 27 is formed as a funnel leading to a waste chute 46 at a bottom of the chamber frame 27. All of the treating material and debris utilized or created in the treating process is collected into the waste chute 46 by the funneled bottom surface 44. The treating material and debris utilized or created in the treating process that pass through the waste chute 46 can be separated (e.g., using a cyclone separator), and the unwanted debris and other solid matter can be discharged downwardly into a waste collector and the particulate treating media can be separated and sent to the nozzle movable arm systems 20 for reuse for treating the workpiece 12. For example, reusable abrasive media can be entrained in a supply of pressurized carrier fluid such as air or water, and the pressurized media (i.e., the fluid with entrained abrasive particles) is then supplied to the nozzle movable arm systems 20 for treating the workpiece 12.

The illustrated nozzle movable arm systems 20 receive the pressurized treatment material and supply the pressurized treatment material to the workpiece 12 through the nozzle members 14 to finish the workpiece 12. Each nozzle movable arm system 20 is positioned on the surface 30 and includes a fixed base 48 having an arm assembly 50 rotatably connected thereto. The arm assembly 50 includes a plurality of arms 52 that rotate relative to each other and the nozzle member 14 connected to an end arm 52. The arm assembly 50 allows for full three dimensional movement of the nozzle member 14 at the end of the arm assembly 50 for selectively positioning the nozzle member 14. A computer system has full control of each of the arms 52 of each of the arm assemblies 50 to allow for controlled movement of each of the nozzle members 14. Tubing 54 extends along or through the base 48 and the arm assembly 50 to supply the pressurized treatment material to the nozzle member 14 for spraying in the workpiece 12 as outlined below.

In the illustrated example, the workpiece movable arm system 22 is configured to position the workpiece 12 in position within the main housing 18 and to remove the workpiece 12 from the main housing 18 after treatment is completed on the workpiece 12. Although not shown, conveyors or similar systems could be located adjacent the workpiece movable arm system 22 for supplying workpieces 12 to the workpiece movable arm system 22 for treatment and/or taking workpieces away from the workpiece treatment station 10 for storage or further processing. The workpiece movable arm system 22 is positioned on the surface 30 and includes a fixed base (not shown) having an arm assembly 56 rotatably connected thereto. The arm assembly 56 includes a plurality of arms 58 that rotate relative to each other and a clamp 60 connected to an end arm 58. The arm assembly 56 allows for full three dimensional movement of the clamp 60 for selectively positioning the clamp 60 in a position to grasp and release the workpiece 12 as desired. A computer system has full control of each of the arms 58 of the arm assembly 56 to allow for controlled movement of the clamp 60.

The illustrated workpiece 12 is secured within the main housing 18 by the rotatable workpiece-supporting turntable 26. The rotatable workpiece-supporting turntable 26 includes a plurality of clamp fingers 62 for securely holding the workpiece 12 once the workpiece 12 is positioned on a surface (not shown) of the rotatable workpiece-supporting turntable 26. The rotatable workpiece-supporting turntable 26 can remain stationary to prevent the workpiece 12 from any movement and can rotate if necessary to allow the nozzle members 14 to enter the workpiece 12 as needed.

In the illustrated example, the nozzle members 14 are inserted into the workpiece 12 to finish the workpiece 12. Each of the nozzle members 14 includes an elongate tube 70 which is mounted within a holder 72 at the end of the arm assembly 50 of the workpiece movable arm system 22. The tube 70 has an elongate flow passage 74 which extends coaxially throughout the tube 70 and which terminates at a nozzle or discharge opening 77 at one end thereof. The tubing 54 connects to the other end of the nozzle member 14 for supplying pressurized treatment material (e.g., a pressurized carrier fluid having solid abrasive particles entrained therein) to the tube 70. The other end of the tubing 54 connects to a suitable pressurizing source as well as a supply tank for the treatment material as is well known to those skilled in the art. The tube 70 may be provided with a hollow tip member 76 constructed of a hard and low-wearing material, such as tungsten or silicon carbide or the like, so as to minimize wear created by discharge of the treatment material therethrough. The tip member 76 has a passage 78 therethrough which constitutes an extension of the elongate flow passage 74, with the actual nozzle discharge opening 77 being defined at the end of the tip member 76. The passage 78 through the tip member 76 is preferably elongated along a flow axis and also has a generally elongate cylindrical configuration, or possibly even a slightly converging configuration as the passage projects to the opening 77, so that the pressurized abrasive media upon discharge through the opening 77 will be maintained in a confined stream which, for at least a selected distance outwardly away from the opening 77, will remain generally cylindrical and hence will experience only minimal radial outward dispersion.

Figure 2:
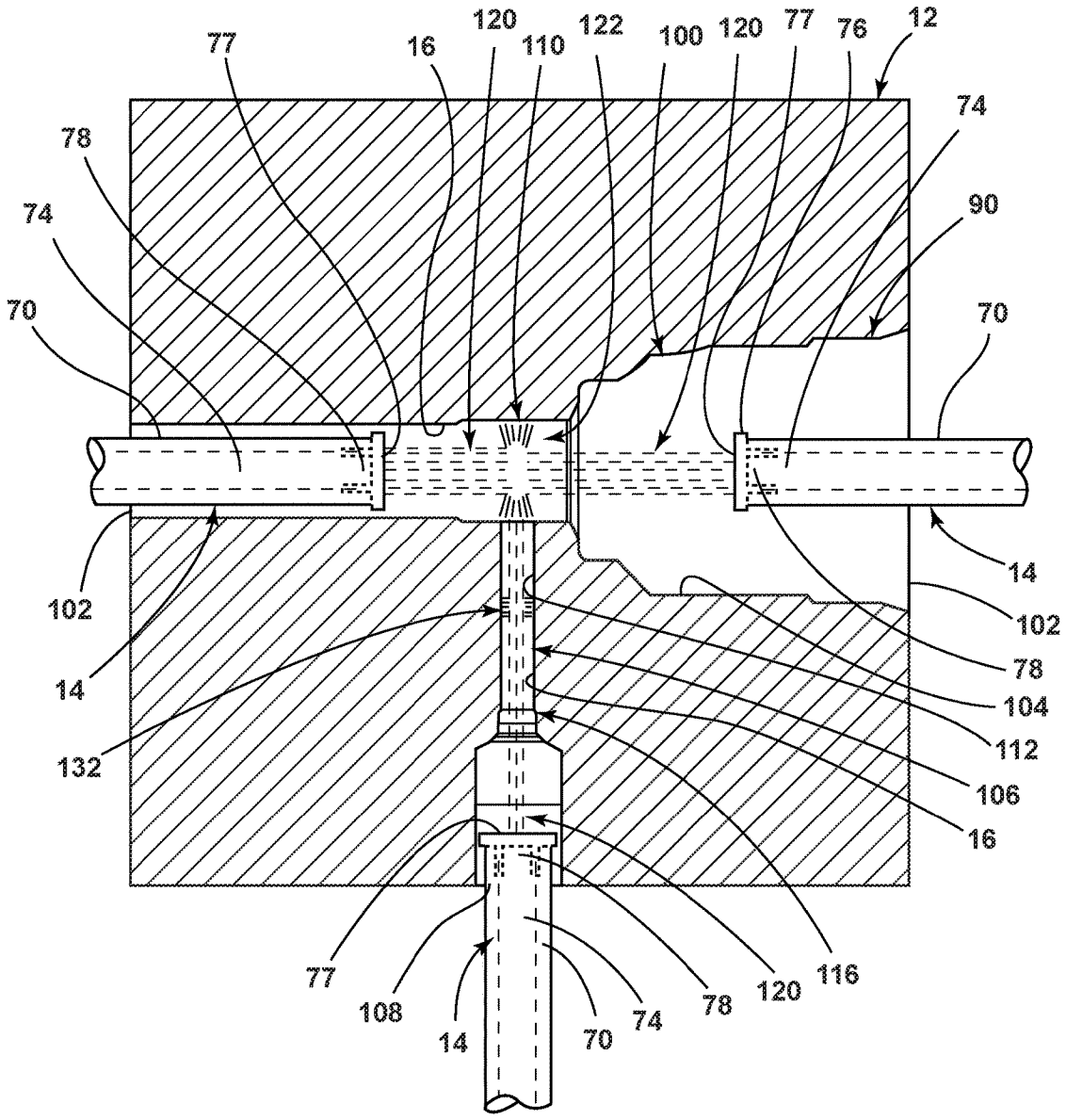
FIG. 2 is a diagrammatic cross sectional view illustrating a workpiece and interior surface treatment thereof by the process and apparatus of the present invention.

FIG. 2 diagrammatically illustrates a horizontal cross section of the workpiece 12 having an interior chamber 90 formed therein. The workpiece 12 can be any item that needs to have the interior surfaces 16 thereof treated. For example, the workpiece can be a cast housing for a valve assembly employing multiple shiftable valve spools, a forging, a fabrication or a part made by machining. The workpiece 12 includes the interior surface 16 to be treated. The illustrated workpiece 12 of FIG. 2 includes a through hole 100 that extends entirely through the workpiece 12, with the through hole 100 including a pair of entrance openings 102. A through hole peripheral surface 104 of the through hole 100 is part of the interior surface 16 of the workpiece 12 to be treated. The workpiece 12 also include a blind hole 106 that extends into the workpiece 12 substantially perpendicularly to the through hole 100. The blind hole 106 includes an entrance opening 108 into the workpiece 12 and meets the through hole 100 at an intersection 110. A blind hold peripheral surface 112 of the blind hole 112 is part of the interior surface 16 of the workpiece 12 to be treated.

In the illustrated example, the nozzle members 14 are moved within the workpiece 12 to finish the interior surfaces 16 of the workpiece. The pressurized treatment material is supplied to each opposed pair of nozzle members 14, each of which emits from the respective discharge opening 77 a generally confined high-velocity stream 120, as defined by the high-velocity treatment material (e.g., a carrier fluid such as gas or liquid having small solid abrasive particles entrained therein). Due to the opposed positions of the discharge openings 77 of the opposed nozzle members 14, the two streams 120 are directed toward one another and directly violently impact one another after discharge from the respective nozzle members 14, which impact causes the streams of treatment material to be deflected radially outwardly in a rather confined first radial stream pattern 122 which surrounds the discharged streams 120, with the treatment material in the first radial stream pattern 122 still being at high velocity so that the treatment material is impacted against the through hole peripheral surface 104. The first radial stream pattern 122 is progressively moved linearly along the through hole 100 so as to effect treating thereof due to the impacting of the treatment material thereagainst. The location of the first radial stream pattern 122 can be moved linearly within the through hole 100 by moving the nozzle members 14, by adjusting the speed of the treatment material leaving the nozzle members 14 (e.g., by adjusting the pressure of the treatment material or by adjusting the size of the nozzle discharge opening 77) or by both methods. U.S. Pat. No. 7,063,593 entitled APPARATUS AND PROCESS FOR SURFACE TREATING INTERIOR OF WORKPIECE, the entire contents of which are hereby incorporated herein by reference, describes one process for treating the through hole peripheral surface 104 of the through hole 100. The process described in U.S. Pat. No. 7,063,593 can be reproduced to treat the through hole peripheral surface 104 of the through hole 100.

In the illustrated example, movement of the nozzle members 14 and of the first radial stream pattern 122 causes the high velocity treatment material to effect treating of the interior surface 16. The timing and/or speed of movement of the nozzle members 14 can be appropriately programmed to permit the nozzle members 14 to either momentarily pause and/or move at a slower rate so as to provide more intensive surface treatment at selected locations along the travel path. The movement of the nozzle members 14 may be slowed down when the discharge opening 77 move from a small diameter cross section of through hole 100 into a larger diameter portion of the through hole 100 so as to permit more intensive surface treating in view of the increased surface area and greater spacing of the walls from the discharge opening 77. The actual programming of the nozzle speed and variations thereof will obviously take into account the overall configuration of the interior surface 16 being treated, and the regions thereof which require more intensive surface treatment.

While the method above described treatment of the through hole 100, the process described herein is also used to treat the blind hold peripheral surface 112 of the blind hole 112. As illustrated in FIG. 2, when the first radial stream pattern 122 is located at the intersection 110 of the through hole 100 and the blind hole 106, a portion of the first radial stream pattern 122 is directed down the blind hole 106. The first radial stream pattern 122 in the blind hole 106 will encounter a generally confined high-velocity stream 120 being emitted from the nozzle member 14 in the entrance opening 108 of the blind hole 106. The first radial stream pattern 122 and the generally confined high-velocity stream 120 being emitted from the nozzle member 14 in the entrance opening 108 of the blind hole 106 directly violently impact one another to be deflected radially outwardly in a rather confined second radial stream pattern 132 so that the treatment material is impacted against the through blind hole peripheral surface 112. The second radial stream pattern 132 is progressively moved linearly along the blind hole 106 so as to effect treating thereof due to the impacting of the treatment material thereagainst. The location of the second radial stream pattern 132 can be moved linearly within the blind hole 106 by moving the nozzle member 14 in the entrance opening 108 of the blind hole 106, by adjusting the speed of the treatment material leaving the nozzle members 14 (e.g., by adjusting the pressure of the treatment material or by adjusting the size of the nozzle discharge opening 77) or by both methods. In the illustrated example, movement of the second radial stream pattern 132 causes the high velocity treatment material to effect cleaning of the interior surface 16. The movement of second radial stream pattern 132 can be appropriately programmed to permit the second radial stream pattern 132 to either momentarily pause and/or move at a slower rate so as to provide more intensive surface treatment at selected locations along the travel path. The movement of the second radial stream pattern 132 may be slowed down when moving from a small diameter cross section of blind hole 106 into a larger diameter portion of the blind hole 106 so as to permit more intensive surface treating in view of the increased surface area and greater spacing of the walls. The actual programming of the nozzle speed and variations thereof will obviously take into account the overall configuration of the interior surface 16 being treated, and the regions thereof which require more intensive surface treatment.

Figure 3:
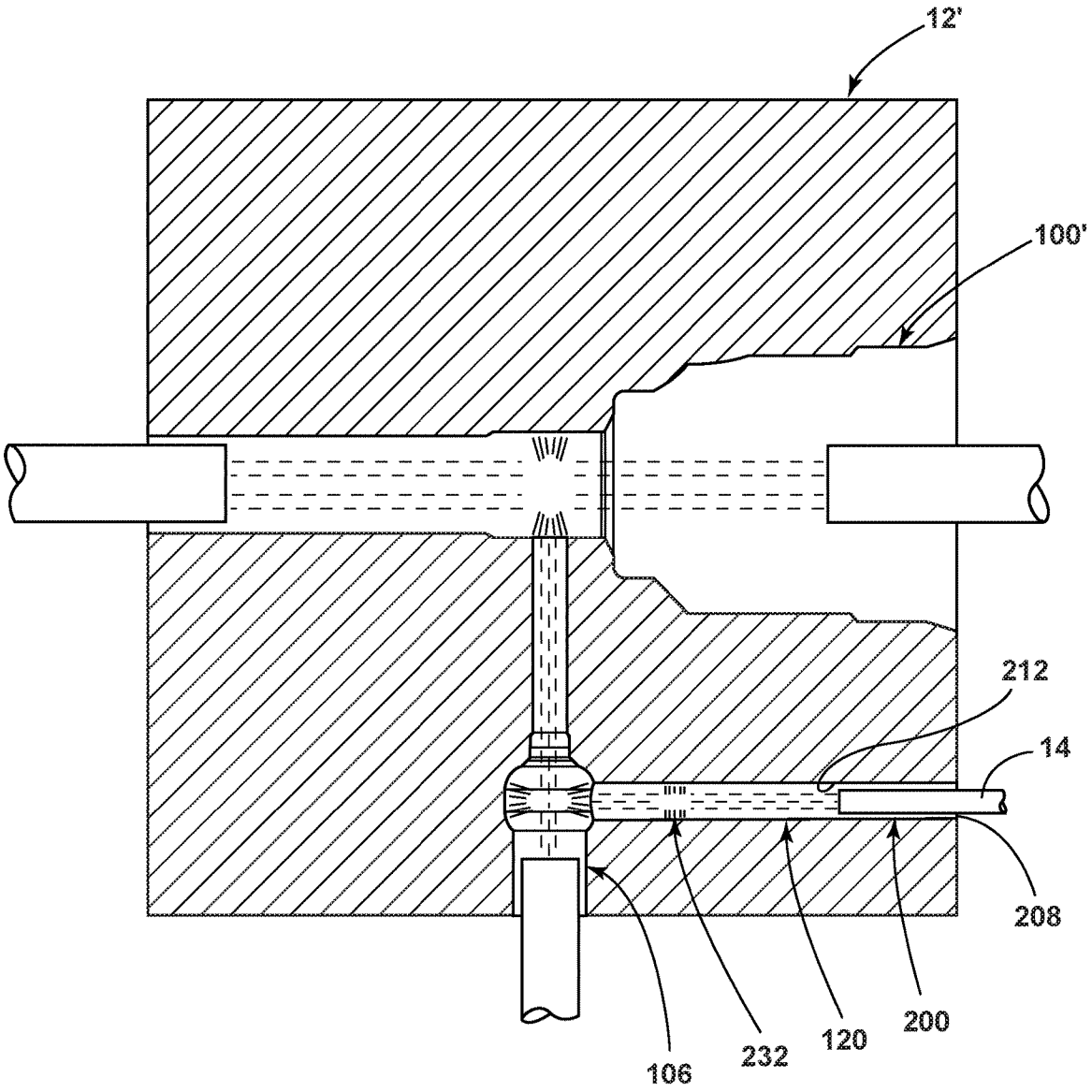
FIG. 3 is a diagrammatic cross sectional illustration of a workpiece and interior surface treatment thereof by a second embodiment of the process and apparatus of the present invention.

FIG. 3 illustrates another workpiece 12' with a through hole 100', a first blind hole 106', with and a second blind hole 200. The through hole 100' and the first blind hole 106 are treated as outlined above. The second blind hole 200 is treated by having the second radial stream pattern 132 in the blind hole 106 will encounter a generally confined high-velocity stream 120 being emitted from the nozzle member 14 in the entrance opening 208 of the second blind hole 200. The second radial stream pattern 132 and the generally confined high-velocity stream 120 being emitted from the nozzle member 14 in the entrance opening 208 of the second blind hole 200 directly violently impact one another to be deflected radially outwardly in a rather confined third radial stream pattern 232 so that the treatment material is impacted against a blind hole peripheral surface 212 of the second blind hole 200. The third radial stream pattern 232 is progressively moved linearly along the second blind hole 200 so as to effect treating thereof due to the impacting of the treatment material thereagainst. The location of the third radial stream pattern 232 can be moved linearly within the second blind hole 200 by moving the nozzle member 14 in the entrance opening 208 of the second blind hole 200, by moving the nozzle member 14 in the entrance opening 108 of the first blind hole 106', by adjusting the speed of the treatment material leaving the nozzle members 14 (e.g., by adjusting the pressure of the treatment material or by adjusting the size of the nozzle discharge opening 77) or by both methods. In the illustrated example, movement of the third radial stream pattern 232 causes the high velocity treatment material to effect treating of the interior surface 16. The movement of third radial stream pattern 232 can be appropriately programmed to permit the third radial stream pattern 232 to either momentarily pause and/or move at a slower rate so as to provide more intensive surface treatment at selected locations along the travel path. The movement of the third radial stream pattern 232 may be slowed down when moving from a small diameter cross section of second blind hole 200 into a larger diameter portion of the second blind hole 200 so as to permit more intensive surface treating in view of the increased surface area and greater spacing of the walls. The actual programming of the nozzle speed and variations thereof will obviously take into account the overall configuration of the interior surface 16 being finished, and the regions thereof which require more intensive surface treatment.

While particular workpieces 12, 12' have been shown, any workpieces with through holes and blind holes intersecting with through holes or other blind holes can be treated as outlined above. It is contemplated that any number of blind holes can intersect with a through hole or a blind hole and can be treated as outlined above.

An aspect of the workpiece treatment station 10 as describe herein is that a spray from a nozzle member 14 can encounter spray from another nozzle member 14 to change direction in a first radial direction and then once again encounter spray from yet another nozzle member to change direction in a second radial direction (e.g., spray material from a single nozzle member can have two 90° turns before contacting a surface to be treated). It is contemplated that a fixed or movable arcuate shield connected to a nozzle member 14 can be positioned wherein streams intersect and form a radial stream pattern to prevent the radial stream patter from contacting the wall at the intersection and only stream down a hole at the intersection.

It is contemplated that the treatment material can utilize air as the blasting fluid so as to permit desired impacting of blasted abrasive media against the walls of the chamber while at the same time permitting the air to escape from the chamber through annular clearance spaces which exist where the nozzle members project through the access openings. It is also contemplated that the treatment material can be any treating and/or cleaning material including shot peening material and can be used to clean, deburr and shot peen the workpiece.

If the treatment material includes abrasive media, the abrasive media may assume many different conventional shapes, sizes and materials and, in one embodiment, may involve small metal balls or shot since experimental testing has indicated that such perform in a desirable manner. The present system is believed to provide effective blasting over a wide range of nozzle discharge velocities, which range may vary from as low as from about 30 feet per second up to as high as about 250 feet per second. The actual range which will more commonly be used, however, will be based on the pressure of the available pressurized air which, in typical manufacturing facilities, is about 80 to 90 psi. In addition, while it is contemplated that the abrasive particles will already be entrained in the pressurized high-velocity carrier fluid as it is supplied to the nozzle members, such as illustrated by FIG. 2, nevertheless it will be apparent that other nozzle constructions can be utilized, including nozzles which are supplied with the carrier fluid and which, by creation of a vacuum, effect sucking of the abrasive into a mixing chamber of the nozzle so as to entrain the abrasive within the carrier fluid. The media may involve a wide variety of particulate solid material, including plastic abrasives, metal grit, glass beads, metal shot and the like, although use of spherical abrasive media may consistently provide higher performance characteristics.

In addition, after the interior chamber of the workpiece 12 has been blasted as described above, the abrasive media which is supplied to and entrained in the blasting streams can be shut off so that solely the pressurized carrier fluid is supplied to the opposed nozzles, which opposed nozzles can still be moved throughout the length of the interior chamber, whereupon the carrier fluid can be used to effect flushing of abrasive and debris from the interior chamber.

It will be further appreciated that, while the system described above utilizes elongate rigid pipelike nozzle members for penetration into the interior chamber of the workpiece, in some situations the elongate rigid nozzle member may be replaced by a suitable flexible conduit or hose having a nozzle tip, such as a carbide tip at the end of the hose for controlling the discharge of the blasting media. Use of such flexible nozzle member may be advantageous in situations where portions of an interior chamber are difficult to access, although use of a flexible hose may result in increased wear problem with respect to confinement of the blasting media.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A method of treating an interior surface of a workpiece comprising:

providing at least three nozzles ejecting treating material, a first one and a second one of the at least three nozzles ejecting the treating material substantially along a first line and a second line, respectively, the first line and the second line being substantially collinear, a third one of the at least three nozzles ejecting the treating material substantially along a third line substantially perpendicular to the first line and the second line;

intersecting the treating material ejected from the first one of the at least three nozzles with the treating material ejected from the second one of the at least three nozzles at a first intersection area;

radially deflecting the treating material ejected from the first one of the at least three nozzles and the treating material ejected from the second one of the at least three nozzles at the first intersection area to form a first radial spray of treating material;

intersecting the treating material ejected from the third one of the at least three nozzles with the first radial spray at a second intersection area;

radially deflecting the treating material ejected from the third one of the at least three nozzles and the first radial spray at the second intersection area to form a second radial spray of treating material; and treating the interior surface of the workpiece adjacent the second intersection area with the treating material of the second radial spray.

2. The method of treating the interior surface of the workpiece of claim 1, wherein:

the at least three nozzles includes at least four nozzles; and further including:

intersecting the treating material ejected from a fourth one of the at least four nozzles with the second radial spray at a third intersection area;

radially deflecting the treating material ejected from the fourth one of the at least four nozzles and the second radial spray at the third intersection area to form a third radial spray of treating material; and treating the interior surface of the workpiece adjacent the third intersection area with the treating material of the third radial spray.

3. The method of treating the interior surface of the workpiece of claim 2, further including:

moving a first intersection area location of the first intersection area to treat various areas of the interior surface of the workpiece adjacent the first intersection area.

4. The method of treating the interior surface of the workpiece of claim 3, further including:

moving a second intersection area location of the second intersection area to treat various areas of the interior surface of the workpiece adjacent the second intersection area.

5. The method of treating the interior surface of the workpiece of claim 4, further including:

moving a third intersection area location of the third intersection area to treat various areas of the interior surface of the workpiece adjacent the third intersection area.

6. The method of treating the interior surface of the workpiece of claim 5, wherein:

at least one of the first intersection area location, the second intersection area location and the third intersection area location are moved by moving at least one of the at least four nozzles.

7. The method of treating the interior surface of the workpiece of claim 5, wherein:

at least one of the first intersection area location, the second intersection area location and the third intersection area location are moved by adjusting an ejection pressure of at least one of the at least four nozzles.

8. The method of treating the interior surface of the workpiece of claim 1, further including:

moving a first intersection area location of the first intersection area to treat various areas of the interior surface of the workpiece adjacent the first intersection area.

9. The method of treating the interior surface of the workpiece of claim 8, further including:

moving a second intersection area location of the second intersection area to treat various areas of the interior surface of the workpiece adjacent the second intersection area.

10. The method of treating the interior surface of the workpiece of claim 9, wherein:

at least one of the first intersection area location and the second intersection area location are moved by moving at least one of the at least three nozzles.

11. The method of treating the interior surface of the workpiece of claim 9, wherein:

at least one of the first intersection area location and the second intersection area location are moved by adjusting an ejection pressure of at least one of the at least three nozzles.

* * * * *